US008074390B2

(12) United States Patent
Rain

(10) Patent No.: US 8,074,390 B2
(45) Date of Patent: Dec. 13, 2011

(54) DISPLAY BOX

(76) Inventor: Michele Trevison Rain, Northport, WA (US)

( * ) Notice: Subject to any disclaimer, the term of this patent is extended or adjusted under 35 U.S.C. 154(b) by 107 days.

(21) Appl. No.: 12/459,735

(22) Filed: Jul. 6, 2009

(65) Prior Publication Data

US 2011/0000116 A1 Jan. 6, 2011

(51) Int. Cl.
*A47G 1/06* (2006.01)

(52) U.S. Cl. ..... 40/721; 40/722; 40/723

(58) Field of Classification Search ..... 40/721–724
See application file for complete search history.

(56) References Cited

U.S. PATENT DOCUMENTS

| | | | | |
|---|---|---|---|---|
| 2,029,221 | A | 1/1936 | Burgess et al. | |
| 2,040,279 | A * | 5/1936 | Soss | 16/273 |
| D137,686 | S | 4/1944 | Maienthau | |
| 2,649,799 | A * | 8/1953 | Spertus | 40/721 |
| 2,665,808 | A | 1/1954 | McAlister | |
| 2,721,353 | A * | 10/1955 | Mackintosh | 16/294 |
| 2,740,550 | A * | 4/1956 | Irelan | 220/326 |
| 2,850,294 | A | 9/1958 | Ortis et al. | |
| 3,589,049 | A * | 6/1971 | Cornelius | 40/722 |
| 3,945,140 | A | 3/1976 | Sullivan et al. | |
| 4,164,085 | A | 8/1979 | Steeb et al. | |
| 4,244,303 | A * | 1/1981 | Kurasik | 109/23 |
| 4,434,567 | A | 3/1984 | LeVeau | |
| D278,666 | S | 5/1985 | McCartin | |
| D288,943 | S | 3/1987 | Kroll | |
| 4,648,548 | A | 3/1987 | Shin | |
| 4,653,207 | A | 3/1987 | Wisniewski | |
| 4,752,230 | A | 6/1988 | Shimizu | |
| 4,778,051 | A | 10/1988 | Schaub et al. | |
| 4,794,713 | A | 1/1989 | Yang | |
| 4,863,026 | A | 9/1989 | Perkowski | |
| 4,991,767 | A | 2/1991 | Wyant | |
| D318,302 | S | 7/1991 | Ostrander | |
| D407,432 | S | 8/1992 | Morita | |
| 5,135,110 | A | 8/1992 | Morita | |
| 5,167,085 | A * | 12/1992 | Yang | 40/711 |
| D335,304 | S | 5/1993 | Gordon | |
| 5,273,319 | A | 12/1993 | Lee | |
| 5,285,900 | A | 2/1994 | Swingler | |
| 5,360,234 | A | 11/1994 | Miller et al. | |
| 5,508,006 | A | 4/1996 | Gabele et al. | |
| 5,893,453 | A | 4/1999 | Ishikawa | |
| 5,992,073 | A | 11/1999 | Wolpa | |
| 6,142,696 | A | 11/2000 | Tan | |
| 6,478,336 | B2 | 11/2002 | Tran | |
| D477,361 | S | 7/2003 | Park | |
| 6,764,242 | B1 | 7/2004 | Karten et al. | |
| 6,845,582 | B1 * | 1/2005 | Ho et al. | 40/711 |
| 6,959,507 | B2 | 11/2005 | Bazanny et al. | |
| D520,755 | S | 5/2006 | Sakaguchi | |

(Continued)

*Primary Examiner* — Casandra Davis
(74) *Attorney, Agent, or Firm* — Charles J. Rupnick Attorney at Law

(57) ABSTRACT

A decorative display box having a picture frame lid fitting flush with its storage box base, hinges between the picture frame lid box base being of a type that is hidden when the lid is closed over the box base. A magnetic securing mechanism secures the lid in the closed position with the box base. The picture frame lid having a an inner peripheral picture slot with an edge slot opening thereinto for installing and removing the a picture stack from the frame. A door slide portion of the picture frame lid fits over picture slot adjacent one end of the picture frame and is secured in a closed position therewith by another magnetic securing mechanism.

20 Claims, 13 Drawing Sheets

U.S. PATENT DOCUMENTS

| | | | | |
|---|---|---|---|---|
| D531,800 | S | 11/2006 | Sakaguchi | |
| D531,801 | S | 11/2006 | Sakaguchi | |
| 7,131,224 | B1 | 11/2006 | Elliott et al. | |
| D545,894 | S | 7/2007 | Park | |
| D559,906 | S | 1/2008 | Sakaguchi | |
| D573,636 | S | 7/2008 | Sakaguchi | |
| 7,469,930 | B2 | 12/2008 | Thomsen | |
| D587,463 | S | 3/2009 | Franco | |
| 2004/0164542 | A1 | 8/2004 | Crawford | |
| 2007/0084743 | A1* | 4/2007 | Chu | 206/455 |
| 2008/0000125 | A1* | 1/2008 | Chang | 40/723 |

* cited by examiner

DISPLAY BOX

FIELD OF THE INVENTION

The present invention relates generally to boxes for holding photographs and the like, and in particular to display boxes having hinged a lid formed of a picture frame.

BACKGROUND OF THE INVENTION

Display boxes for holding photographs and the like are generally well-known. Some known display boxes even provide pictures, even photographs, on their lids. However, known display boxes are limited in their ability to readily change the picture displayed on their lids.

SUMMARY OF THE INVENTION

The present invention is a decorative display box having a picture frame lid fitting flush with its storage box base, hinges between the picture frame lid box base being of a type that is hidden when the lid is closed over the box base. A magnetic securing mechanism secures the lid in the closed position with the box base. The picture frame lid having a an inner peripheral picture slot with an edge slot opening thereinto for installing and removing the a picture stack (photograph, support substrate, and protective viewing lens) from the frame. A door slide portion of the picture frame lid fits over picture slot adjacent one end of the picture frame and is secured in a closed position therewith by another magnetic securing mechanism. Hidden-type hinges permit the display box to lie flat with its picture frame lid substantially parallel and coplanar with the storage box.

Other aspects of the invention are detailed herein.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein:

FIG. 6 and FIG. 7 are perspective left and right side top views, respectively, of the novel display box with the picture frame lid configured in closed position over the storage box, wherein FIG. 6 shows hinged edges of the storage box and picture frame lid showing that its hinges are completely invisible from outside the display box when its picture frame lid is closed, and FIG. 7 illustrates two pair of fingerholes for opening the picture frame lid;

DETAILED DESCRIPTION OF PREFERRED EMBODIMENT

In the Figures, like numerals indicate like elements.

Figure 1:
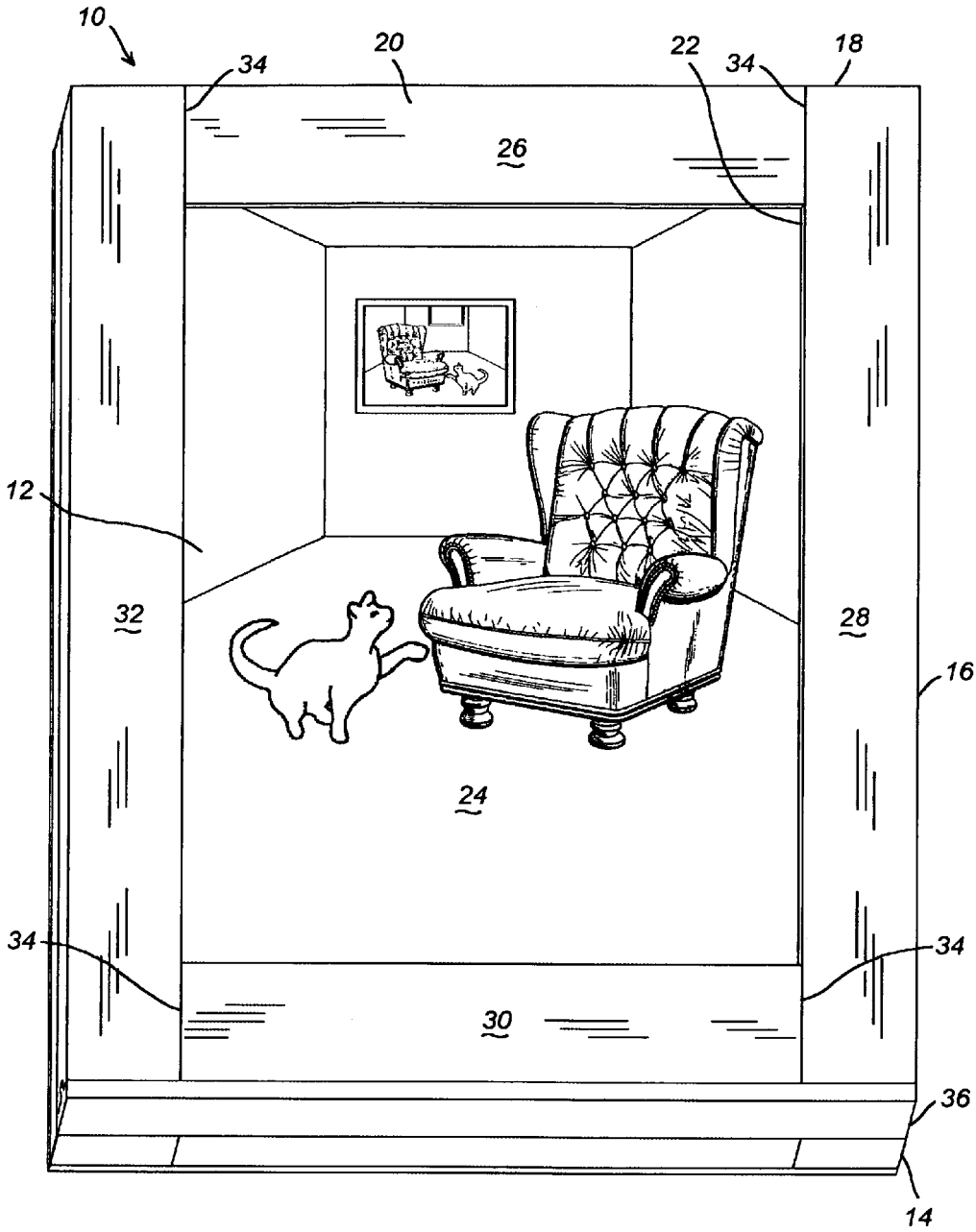
FIG. 1 is a perspective view showing an example of a novel decorative display box having a picture frame lid for displaying a picture card, such as a favorite photograph, post card, painting or other image, while storing a quantity of additional picture cards.

FIG. 1 is a perspective view showing an example of a novel decorative display box 10 for displaying a picture card 12, such as a favorite photograph, post card, painting or other image. Display box 10 includes a generally rectangular storage box base 14 with a generally rectangular picture frame lid 16. Picture frame lid 16 is formed with a peripheral frame 18 having a front surface 20 framing a picture display opening 22 therein defining a display area 24 for displaying picture card 12. For example, when picture card 12 is a photograph of a standard size, such as 5"×7" or 8" by 10", display area 24 is sized accordingly. Peripheral picture frame 18 is formed, for example, by four interconnected frame members 26, 28, 30, 32 of an appropriate size to aesthetically frame display area 24.

Here, peripheral frame 18 of picture frame lid 16 is formed with straight-cut frame members 26, 28, 30, 32 interconnected at mating corners by butt joints 34. As disclosed herein, picture frame lid 16 includes a door slide 36 that secures picture card 12 within display area 24.

Figure 2:
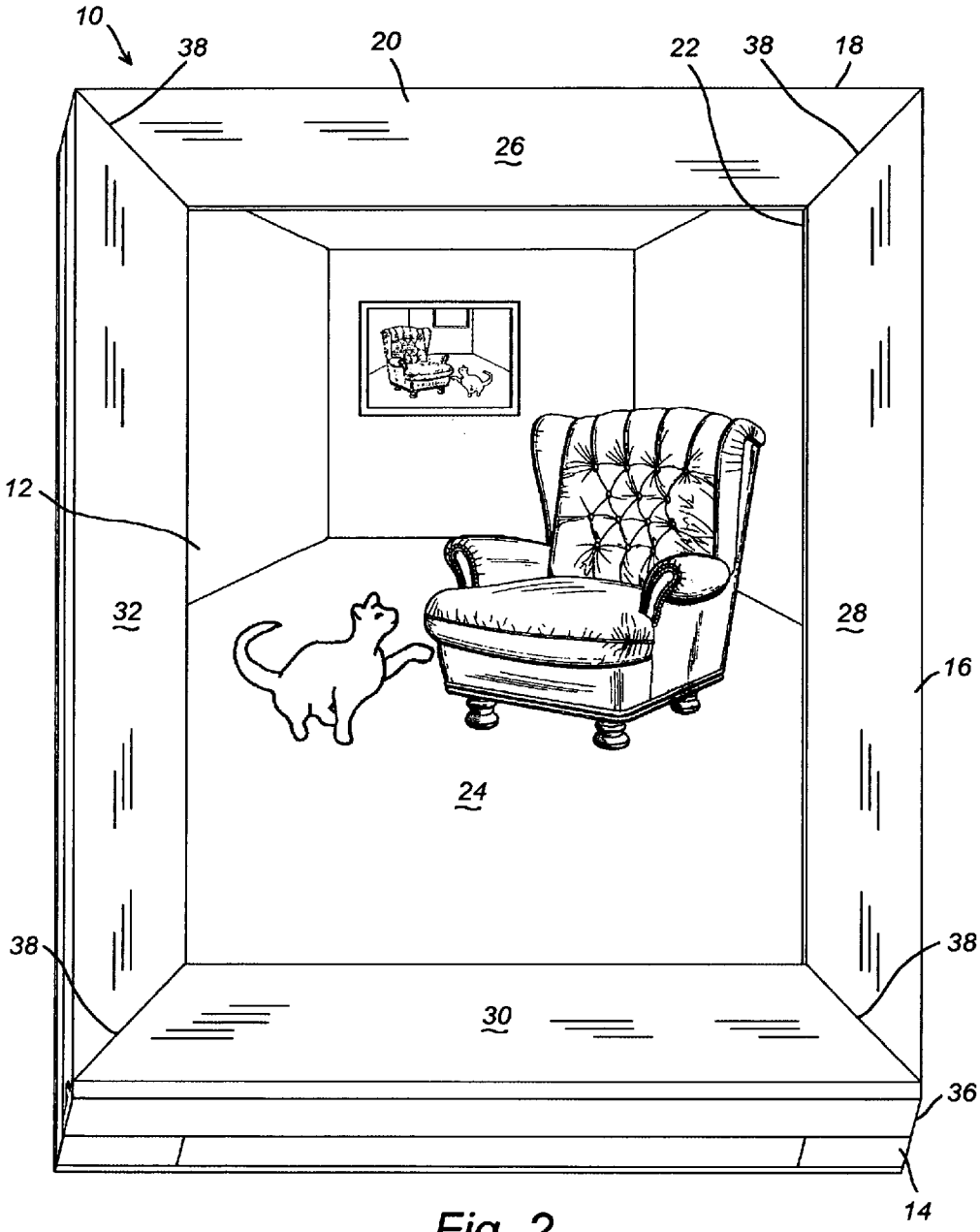
FIG. 2 illustrates an alternative configuration for a peripheral frame of the picture frame lid having diagonal-cut frame members with diagonal joints.

FIG. 2 illustrates an alternative configuration for peripheral frame 18 of picture frame lid 16 having diagonal-cut frame members 26, 28, 30, 32 interconnected at mating corners by diagonal joints 38.

Figure 3:
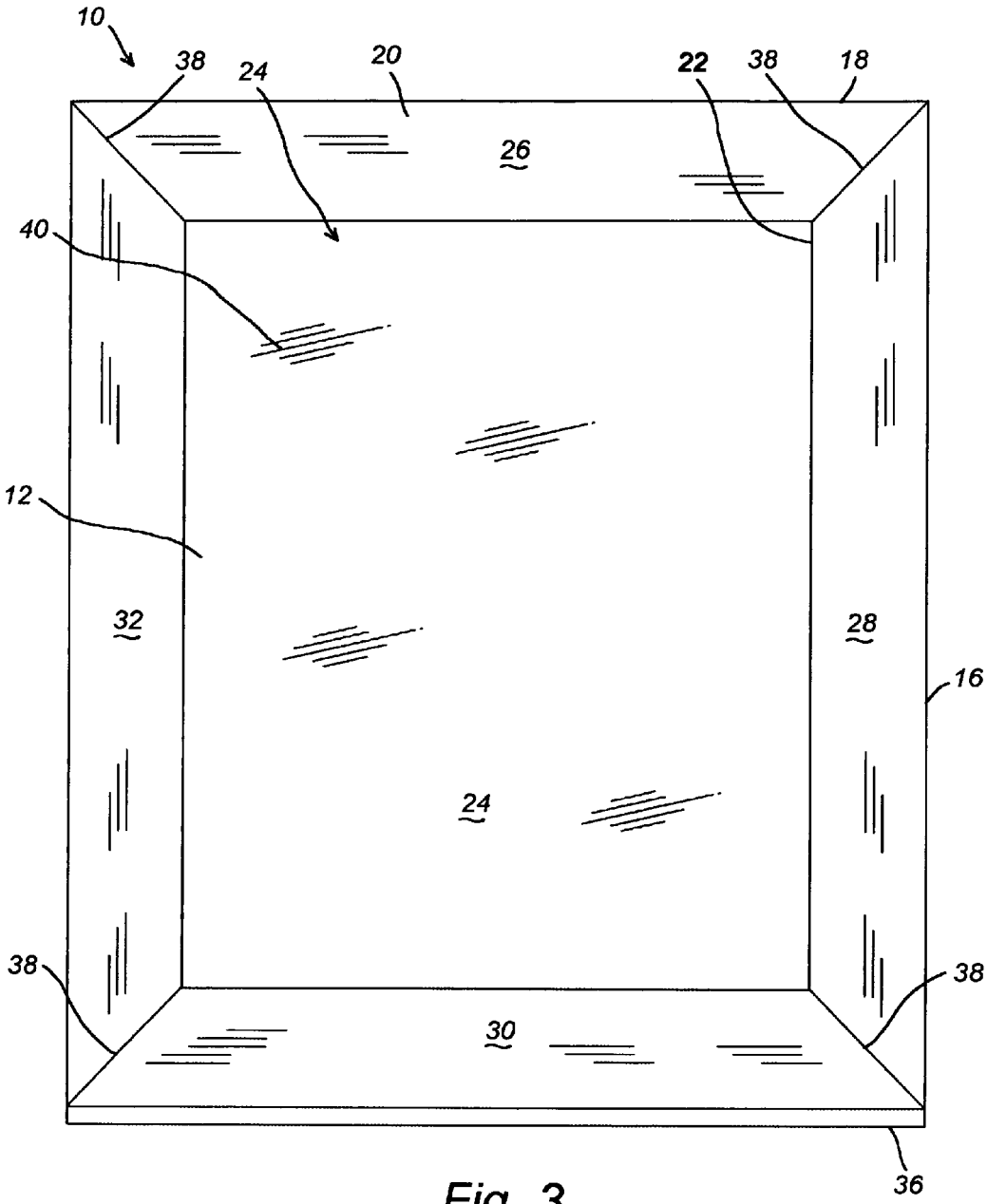
FIG. 3 is a top view of display box showing the generally rectangular picture frame lid covering a generally rectangular storage box for storing additional picture cards.

FIG. 3 is a top view of display box 10 showing generally rectangular picture frame lid 16, inclusive of door slide 36, being substantially the same peripheral dimensions as generally rectangular storage box 14 so as to form a substantially continuous block shape with frame members 26, 28, 30, 32 being substantially flush with the sides of storage box 14. A transparent protective viewing lens 40 is installed in picture display opening 22 of peripheral frame 18 over display area 24 for viewing picture card 12 displayed therein. For example, viewing lens 40 is formed of a clear sheet of triacetate, glass or polycarbonate. Viewing lens 40 thus provides an easily cleaned surface that permits unimpaired viewing of displayed picture card 12 while protecting from spills and other potential damage.

Figure 4:
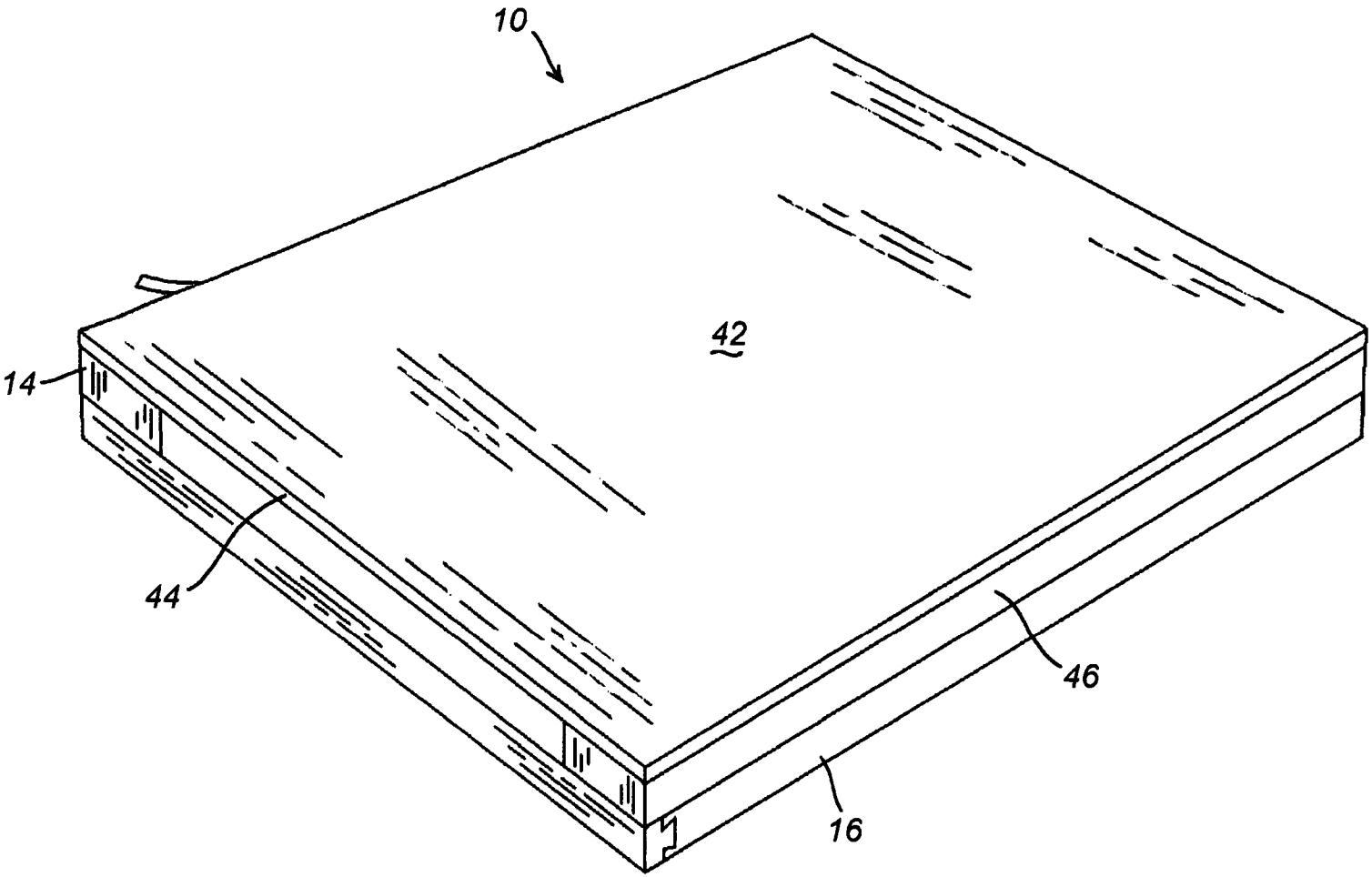
FIG. 4 is a perspective view showing a bottom surface of the novel display box.

FIG. 4 is a perspective view showing a bottom surface 42 of display box 10, which is provided by a generally rectangular base panel 44 formed of a single smooth, continuous sheet of material, such as wood. Base panel 44 is interconnected to a generally rectangular continuous peripheral box frame 46 for forming storage box 14.

Figure 5:
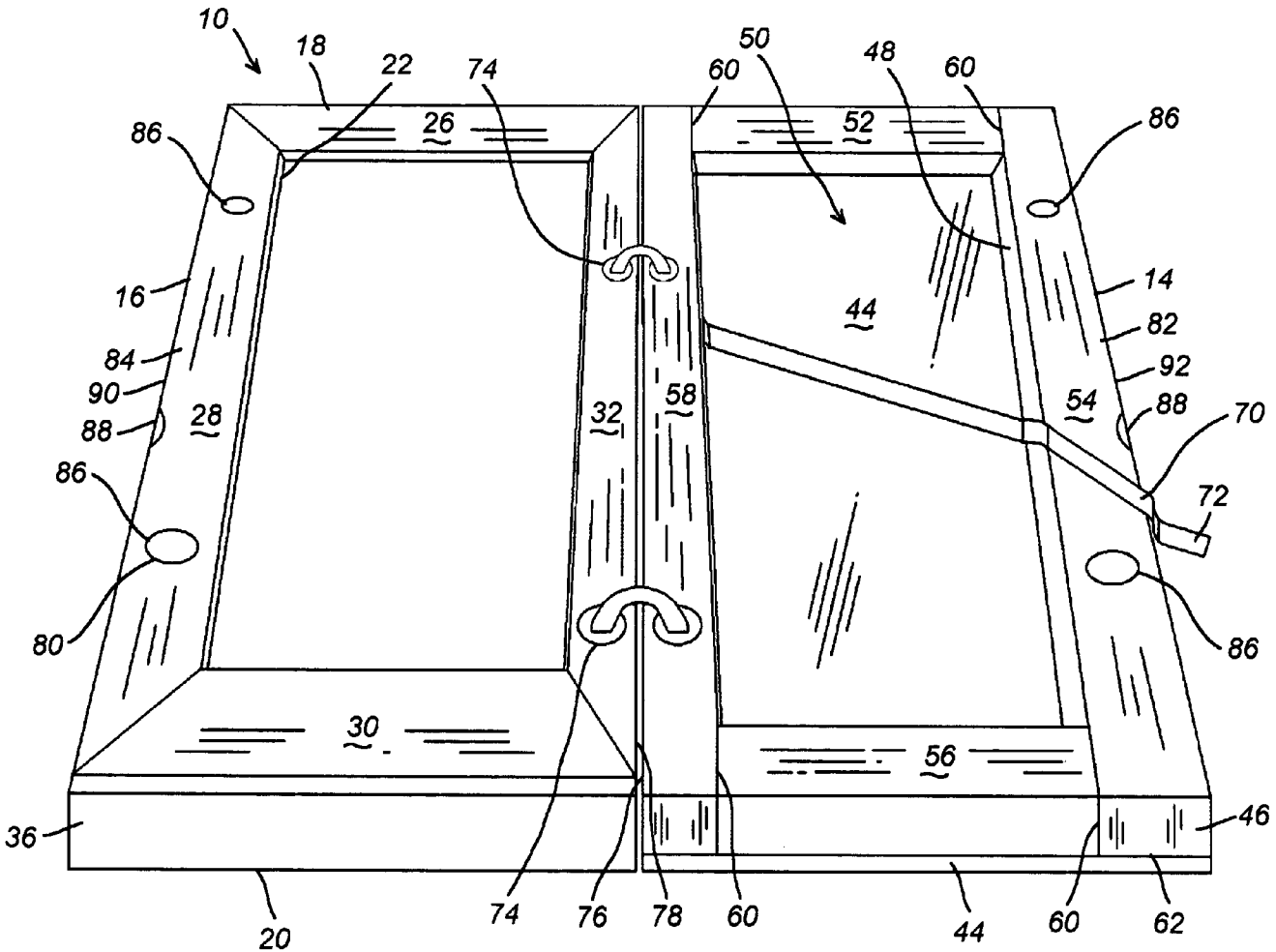
FIG. 5 illustrates the novel display box having its picture frame lid configured in an open position uncovering a generally rectangular opening into an interior cavity of the storage box, wherein hidden-type hinges permit display box to lie flat with picture frame lid substantially parallel and coplanar with storage box.

FIG. 5 illustrates display box 10 having picture frame lid 16 configured in an open position uncovering a generally rectangular opening 48 into an interior cavity 50 of storage box 14 with peripheral picture frame 18 displaced from peripheral box frame 46. Here, door slide 36 is configured in a closed position relative to peripheral picture frame 18 for securing picture card 12 within display area 24 of picture frame lid 16.

Peripheral box frame 46 is shown to be formed by four substantially upright straight-cut side panels 52, 54, 56, 58 mutually interconnected at mating corners by butt joints 60. Alternatively, side panels 52, 54, 56, 58 of peripheral box frame 46 are diagonal-cut and interconnected at mating corners by diagonal joints 38 similarly to alternative configuration for peripheral frame 18 of picture frame lid 16. Base panel 44 is interconnected with side panels 52, 54, 56, 58 of peripheral box frame 46 are along bottom edge 62 of peripheral box frame 46 opposite from generally rectangular opening 48 thereinto. Together, base panel 44 and side panels 52, 54, 56, 58 of peripheral box frame 46 cooperate for defining interior cavity 50 having generally rectangular opening 48. Cavity 50 is sized, for example, to receive and store several picture cards 12 such as photographs of a standard size, such as 5"×7" or 8" by 10". Depth of box cavity 50 is sized according to the maximum quantity of picture cards 12 to be stored therein, or the desired aesthetics of finished display box 10. According to one embodiment, an overall thickness of box 14 is substantially the same as an overall thickness of picture frame lid 16.

A ribbon or other strap 70 is optionally provided for easy retrieval of picture cards 12 stored in cavity 50 of box 14. For example, ribbon strap 70 is coupled into cavity 50, such as between base panel 44 and peripheral box frame 46, and is long enough to span across cavity 50 with an end portion 72 positioned outside of box 14, as shown, to be available to user.

A hinge mechanism composed of one or more hinges 74 pivotally connect adjacent hinged edges 76, 78 of peripheral box frame 46 of storage box 14 and peripheral frame 18 of picture frame lid 16. Accordingly, picture frame lid 16 cooperates to form a lid for storage box 14. Hinges 74 are operable for pivoting picture frame lid 16 between the closed position, shown in FIGS. 1 and 2, covering opening 48 into interior cavity 50 of storage box 14 with peripheral picture frame 18 in substantially continuous contact with peripheral box frame 46, and the open position shown here. Hinges 74 are optionally a type of hidden hinge mechanism that is completely enclosed between mating surfaces of peripheral picture frame 18 and peripheral box frame 46 when picture frame lid 16 is in the closed position relative to storage box 14. For example, hinges 74 are generally of the type disclosed, by example and without limitation, in any of U.S. Pat. No. 819,098 issued May 1, 1906; U.S. Pat. No. 1,648,781 issued Nov. 8, 1927; U.S. Pat. No. 2,203,041 issued Jun. 4, 1940; U.S. Pat. No. 2,770,834 issued Nov. 20, 1956; U.S. Pat. No. 5,946,774 issued Sep. 7, 1999; U.S. Pat. No. 6,829,808 issued Dec. 14, 2004, all incorporated herein by reference, or another type of hidden hinge mechanism. Accordingly, hinges 74 are completely invisible from outside display box 10 when picture frame lid 16 is in the closed position. As illustrated here, hidden hinges 74 permit display box 10 to lie flat with picture frame lid 16 substantially parallel with storage box 14. When picture frame lid 16 is the same thickness with storage box 14, hidden hinges 74 permit picture frame lid 16 to lie substantially coplanar with storage box 14.

A magnetic securing mechanism 80 is positioned between opposing opening edges 82, 84 of peripheral box frame 46 and peripheral picture frame 18 opposite from hinges 74 in hinged edges 76, 78. Magnetic securing mechanism 80 is operable for magnetically securing picture frame lid 16 in the closed position covering opening 48 into interior cavity 50 of storage box 14. Magnetic securing mechanism 80 is, for example, one or more pair of rare earth magnets 86, with one of pair of magnets 86 embedded in each of peripheral box frame 46 and peripheral picture frame 18 in relative positions to effectively interact to generate a magnetic attraction force when picture frame lid 16 is in the closed position relative to storage box 14. Alternatively, a plug of magnetically attractive material, e.g., iron, is substituted for one of the pair of magnets 86 of magnetic securing mechanism 80, without deviating from the scope and intent of the present invention.

One or a pair of fingerholes 88 is provided in opposing opening edges 82, 84 of peripheral box frame 46 and peripheral picture frame 18 opposite from hinges 74. Fingerholes 88 are available on respective outer peripheral edge surfaces 90, 92 of peripheral picture frame 18 and peripheral box frame 46. Fingerholes 88 are thus available outside display box 10 for opening picture frame lid 16 against the attraction force of magnetic securing mechanism 80.

Figure 6:
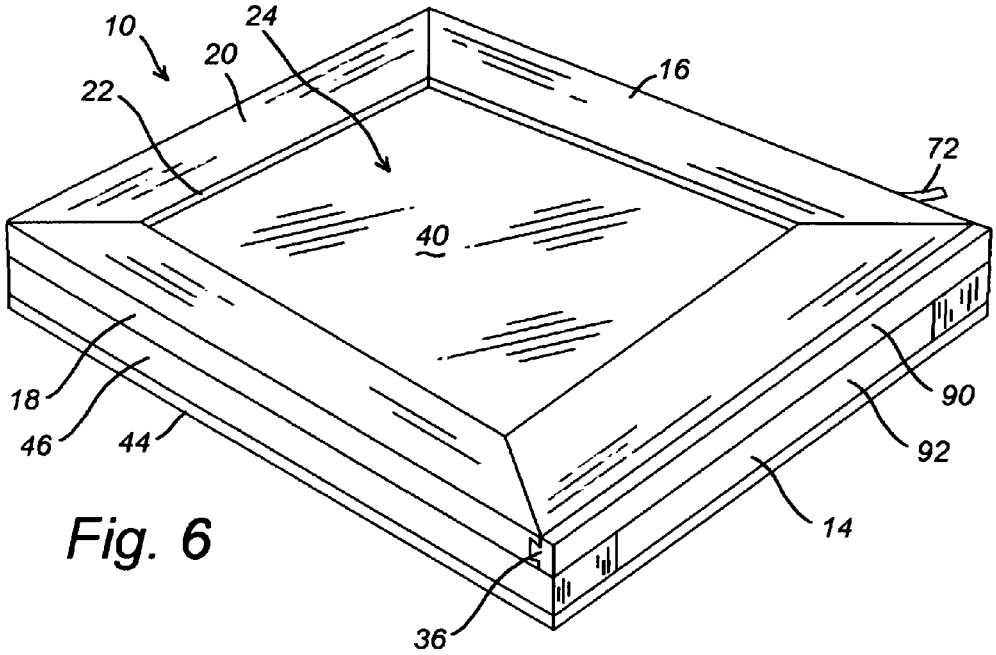
Figure 7:
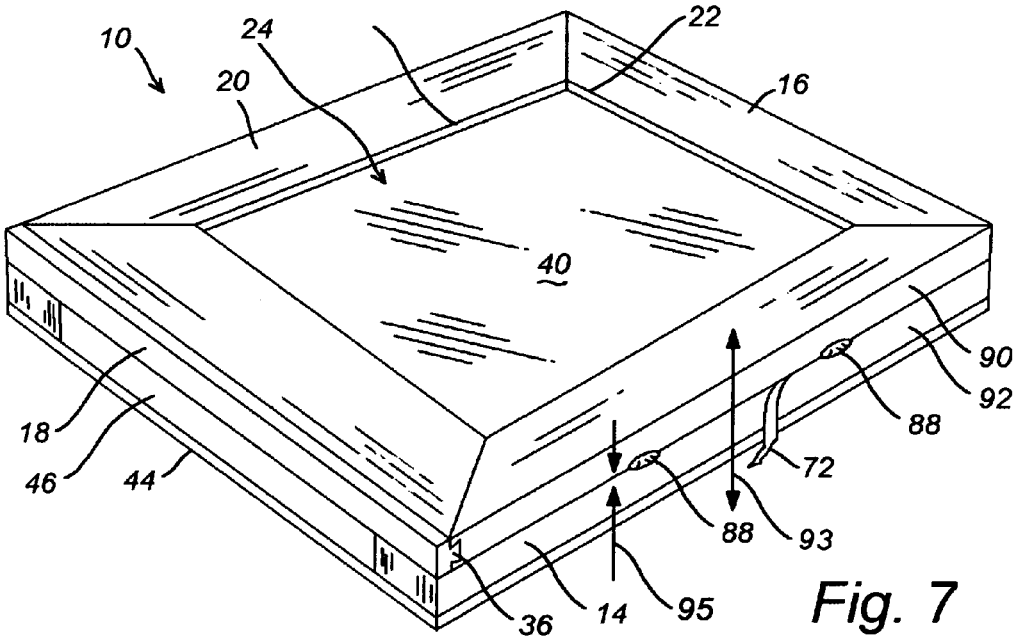

FIG. 6 and FIG. 7 are perspective left and right side top views, respectively, of closed display box 10. As illustrated here, outer peripheral edge surfaces 90, 92 of peripheral picture frame 18 and peripheral box frame 46 are substantially aligned when picture frame lid 16 is in the closed position. Picture frame lid 16, inclusive of door slide 36, is of the substantially the same outside shape and dimensions as storage box 14 so as to form the substantially continuous, generally rectangular block shape of display box 10. As illustrated, end portion 72 of ribbon strap 70 is positioned outside of box 14 to be available to user, e.g., for opening lid 16. Else, end portion 72 of ribbon strap 70 is tucked inside of box 14 to be invisible when not in use.

FIG. 6 shows hinged edges 76, 78 of peripheral box frame 46 of storage box 14 and peripheral frame 18 of picture frame lid 16. As illustrated here, hinges 74 are completely invisible from outside display box 10 when picture frame lid 16 is in the closed position.

FIG. 7 illustrates an optional second pair of fingerholes 88 formed in respective opposing opening edges 82, 84 of peripheral picture frame 18 and peripheral box frame 46. Optionally, at least one pair of fingerholes 88 is used to apply an opening force (arrow 93) for overcoming the securing force (arrow 95) of magnetic securing mechanism 80, and rotating picture frame lid 16 away from storage box 14 for exposing opening 48 into interior storage cavity 50.

Figure 8:
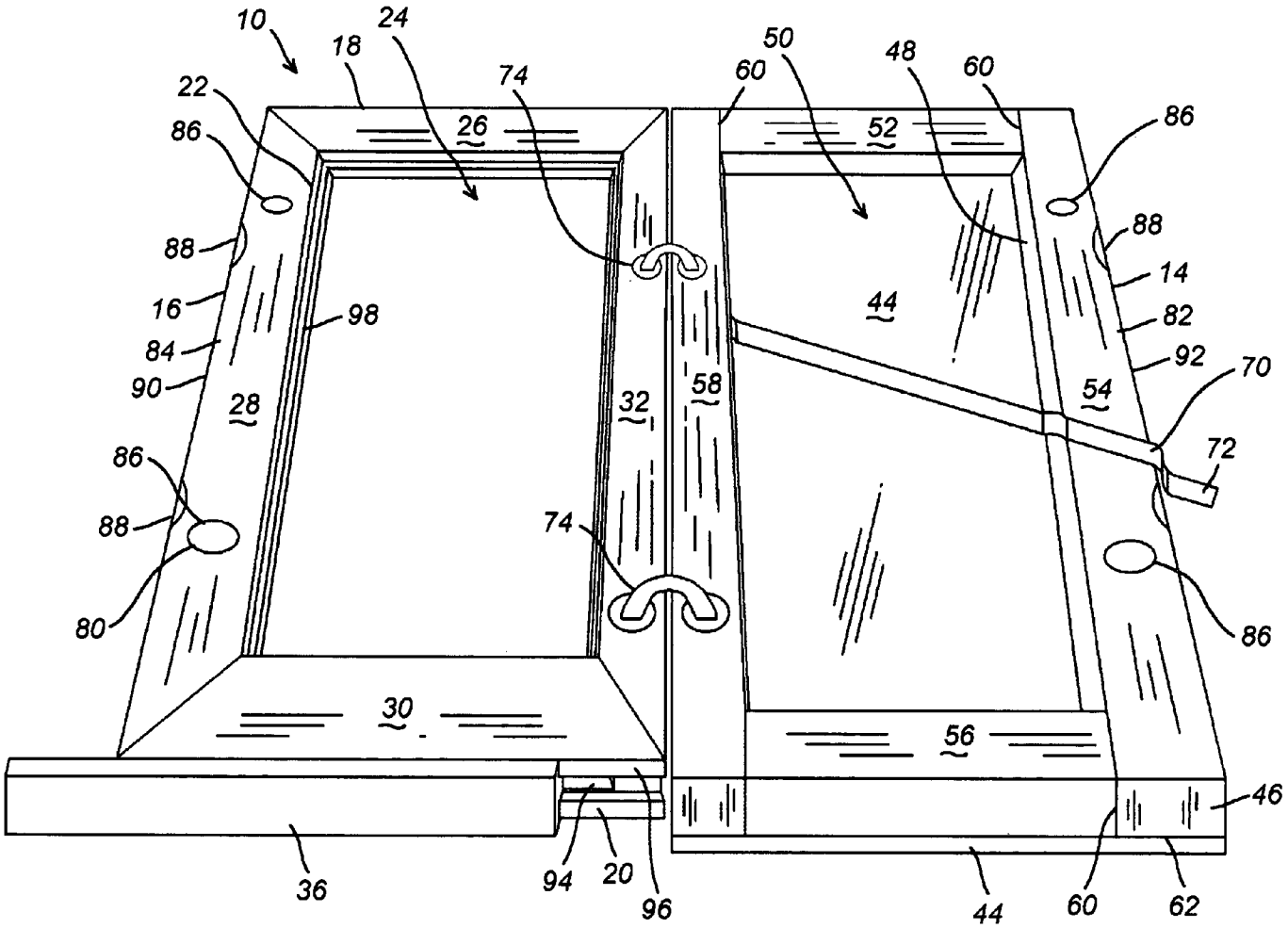
FIG. 8 illustrates the novel display box having its picture frame lid configured in the open position for receiving additional picture cards into the storage box, or removing picture cards therefrom.

FIG. 8 illustrates display box 10 having picture frame lid 16 configured in the open position relative to storage box 14 and illustrating optional second pair of fingerholes 88. Here, door slide 36 is configured in a partially open position relative to peripheral picture frame 18 for accessing edge slot opening 94 through outer peripheral edge surface 90 of peripheral picture frame 18 between front frame surface 20 and an opposing back frame surface 96. As disclosed herein, edge slot opening 94 communicates with an inner peripheral picture slot 98 formed between front and back frame surfaces 20, 96 of peripheral picture frame 18 for receiving and securing picture card 12 within display area 24 of picture frame lid 16.

Figure 9:
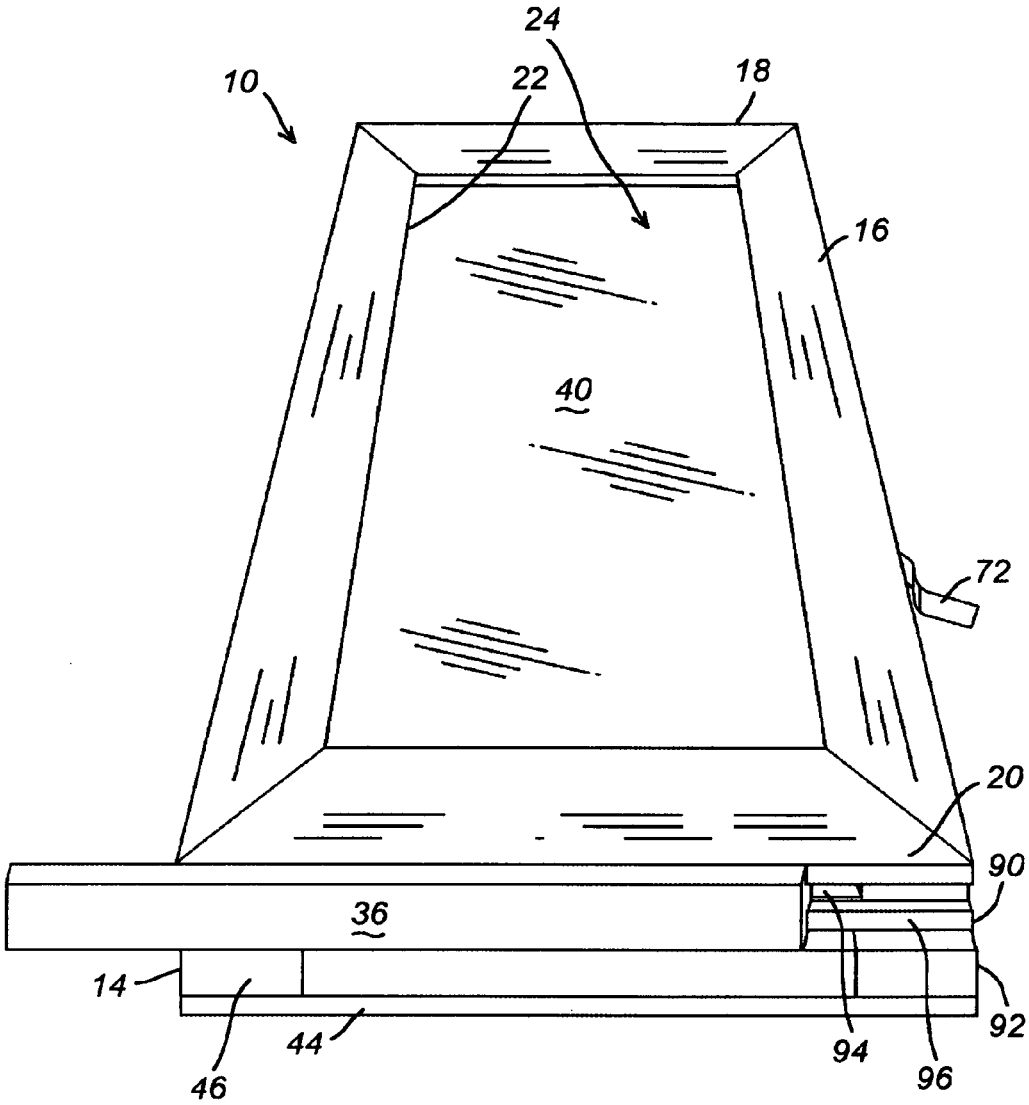
FIG. 9 illustrates the novel display box having its picture frame lid 16 configured in the closed position covering the storage box opening with a door slide configured in a partially open position relative to the peripheral picture frame for partially exposing an inner peripheral picture slot wherein the picture card is displayed.

FIG. 9 illustrates display box 10 having picture frame lid 16 configured in the closed position relative to storage box 14. Door slide 36 is shown here configured in the partially open position relative to peripheral picture frame 18 for partially exposing edge slot opening 94 to inner peripheral picture slot 98.

Figure 10:
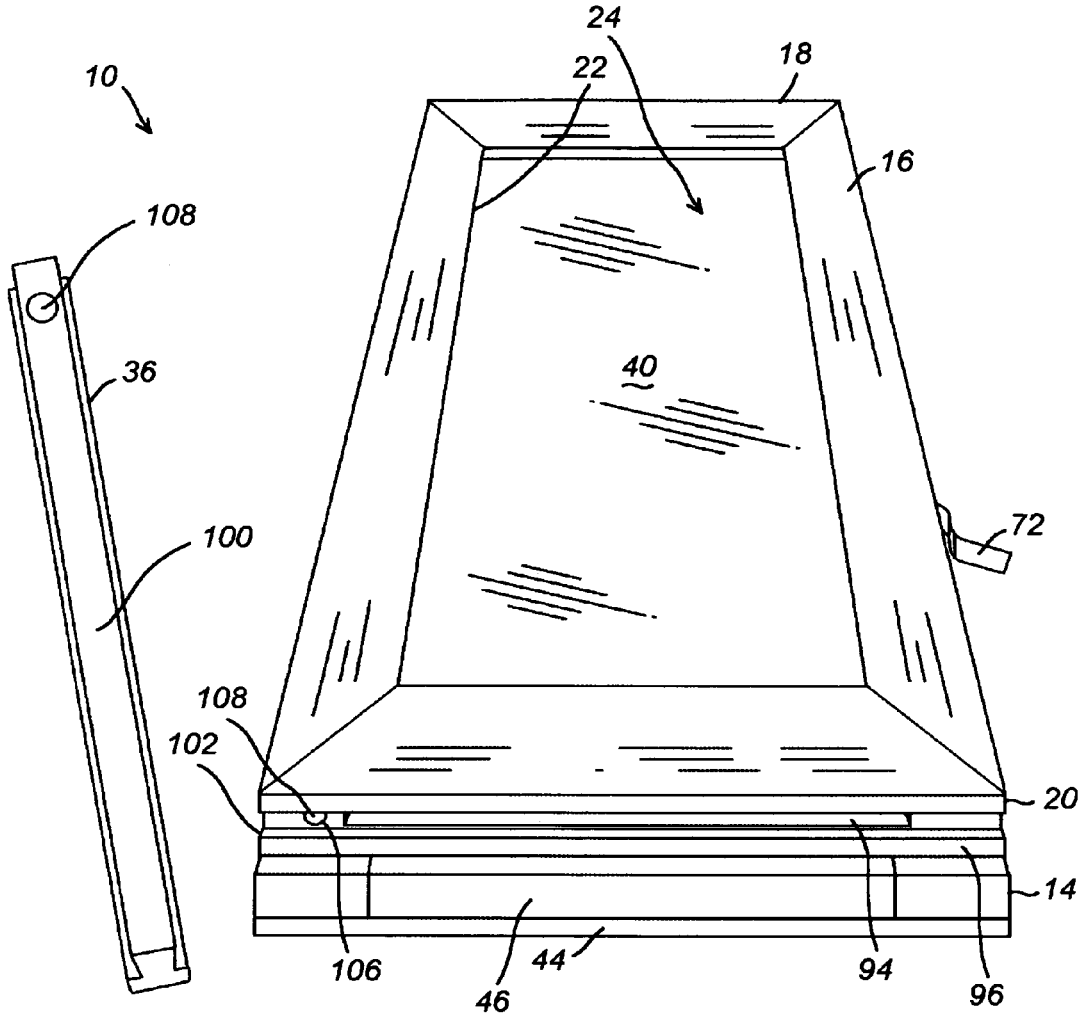
FIG. 10 illustrates the novel display box having its picture frame lid configured in the closed position covering the storage box opening with the door slide removed for accessing the picture card within the inner peripheral picture slot wherein the picture card is displayed.

FIG. 10 illustrates display box 10 having picture frame lid 16 configured in the closed position relative to storage box 14. Here, door slide 36 is removed from peripheral picture frame 18, whereby edge slot opening 94 is fully exposed between opposing front and back frame surfaces 20, 96 for accessing picture card 12 within display area 24 of picture frame lid 16.

Door slide 36 is slideable relative to peripheral picture frame 18 and edge slot opening 94. For example, door slide 36 is formed with a projection 100, and picture frame 18 is formed with a mating slot 102 adjacent to slot opening 94. Projection 100 of door slide 36 is slideable into a slip joint 104 with mating slot 102 of picture frame 18. See, e.g., FIG. 18.

According to one embodiment, projection 100 of door slide 36 is configured as a flaring tenon 100 extended along substantially its entire length, and mating slot 102 of picture frame 18 is configured as a mating mortise extended along its outer peripheral edge surface 90. As disclosed herein, flaring tenon projection 100 of door slide 36 is slideable into a dovetail slip joint 104 with mating mortise slot 102 of picture frame 18. Door slide 36 thus provides a cover for edge slot opening 94 for securing picture card 12 and viewing lens 40 within inner peripheral picture slot 98 and display area 24 of picture frame lid 16.

Optionally, a magnetic securing mechanism 106 is positioned between outer edge surface 90 of the picture frame 18 and door slide 36 for securing door slide 36 in a closed position over edge slot opening 94 into inner peripheral picture slot 98. By example and without limitation, securing closure mechanism 16 is formed of a pair of rare earth magnets 108, with one of the pair of magnets 108 embedded in each of the edge surface 90 of peripheral picture frame 18 and door member 36 in relative positions to effectively interact to generate a magnetic attraction force when door member 36 is in the closed position over edge slot opening 94. Alternatively, a plug of magnetically attractive material, e.g., iron, is substituted for one of the pair of magnets 108 of magnetic securing mechanism 106, without deviating from the scope and intent of the present invention. Optionally, magnetic securing mechanism 16 is formed with more than one pair of rare earth magnets 108 for increased security.

Figure 11:
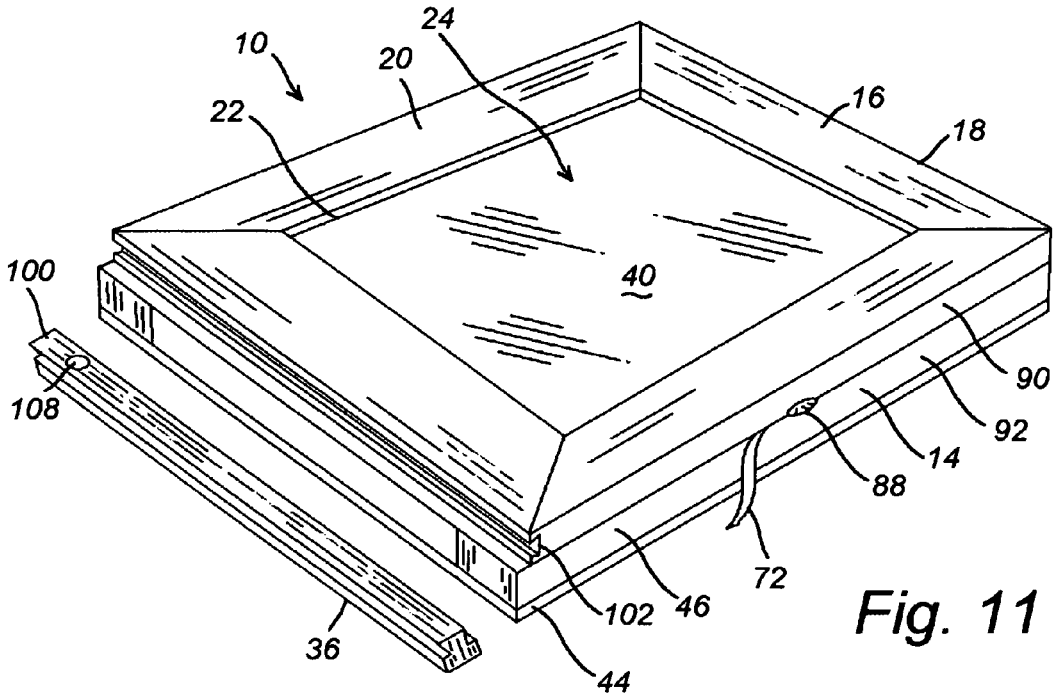
FIG. 11 and FIG. 12 are perspective left side and end top views, respectively, of the closed display box showing the door slide removed for fully exposing edge slot opening for installing or removing picture card from the inner peripheral picture slot.
Figure 12:
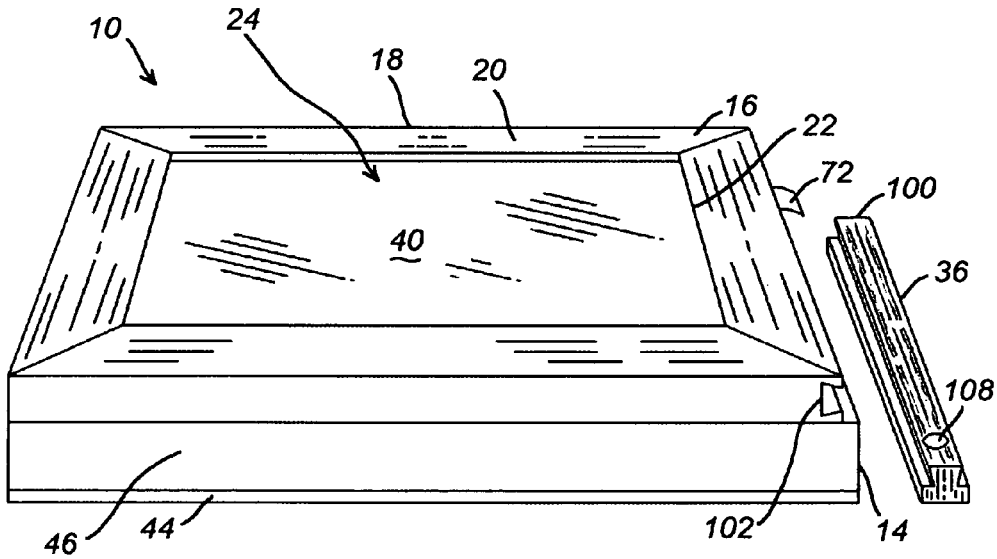

FIG. 11 and FIG. 12 are perspective left side and end top views, respectively, of closed display box 10 showing door slide 36 removed from peripheral picture frame 18 for accessing picture card 12 within display area 24 of picture frame lid 16. Here, edge slot opening 94 is fully exposed for installing or removing picture card 12 and viewing lens 40 from inner peripheral picture slot 98.

Figure 13:
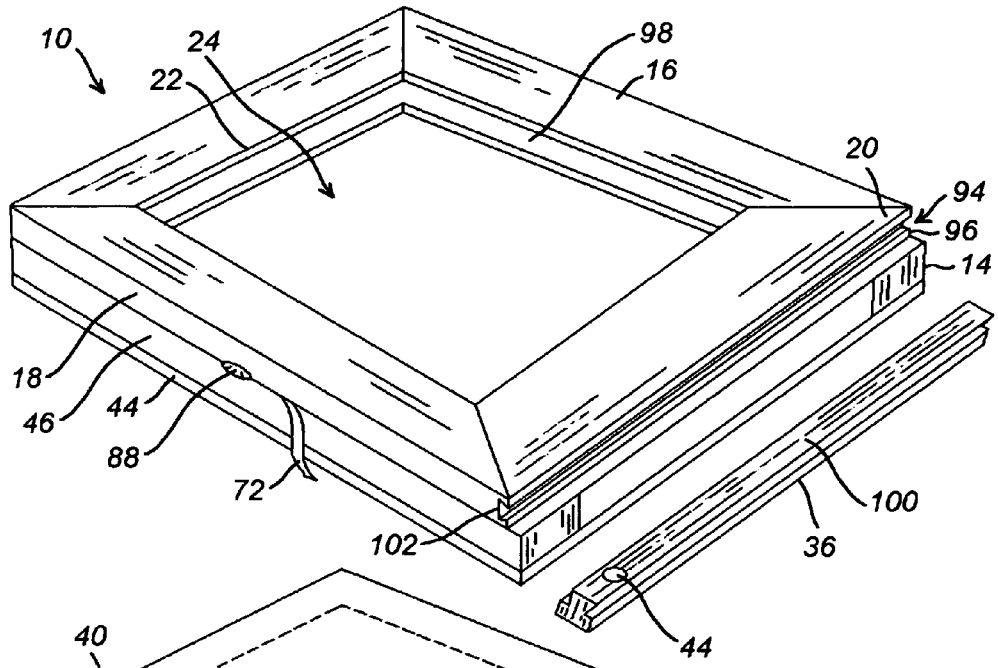
FIG. 13 illustrates closed display box and having its door slide completely removed for accessing the inner peripheral picture slot, and further illustrates a picture card combined in a picture stack with a picture support substrate and a viewing lens.
Figure 13:
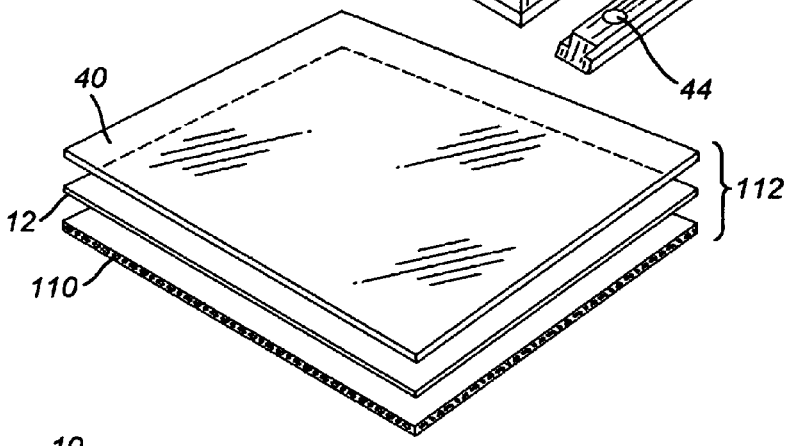

FIG. 13 illustrates closed display box 10 having door slide 36 removed from peripheral picture frame 18 for accessing inner peripheral picture slot 98 through exposed edge slot opening 94. Here, picture card 12 and viewing lens 40 are removed from inner peripheral picture slot 98 of peripheral picture frame 18. A picture support substrate 110, such as a stiff foam or cardboard sheet, is combined with picture card 12 and viewing lens 40 to form a picture stack 112. Inner peripheral picture slot 98 of peripheral picture frame 18 and edge slot opening 94 communicating therewith are sized to receive support substrate 110, picture card 12, and viewing lens 40 as combined picture stack 112. When picture card 12 is placed over support substrate 110 with viewing lens 40 on top, picture stack 112 is compressed and slipped into inner peripheral picture slot 98 of peripheral picture frame 18 through edge slot opening 94 until picture card 12 is displayed in display area 24 of picture frame lid 16. Thereafter, door slide 36 is installed into peripheral picture frame 18 into a position that covers edge slot opening 94 and secures entire combined picture stack 112 within inner peripheral picture slot 98 and display area 24 of picture frame lid 16.

Figure 14:
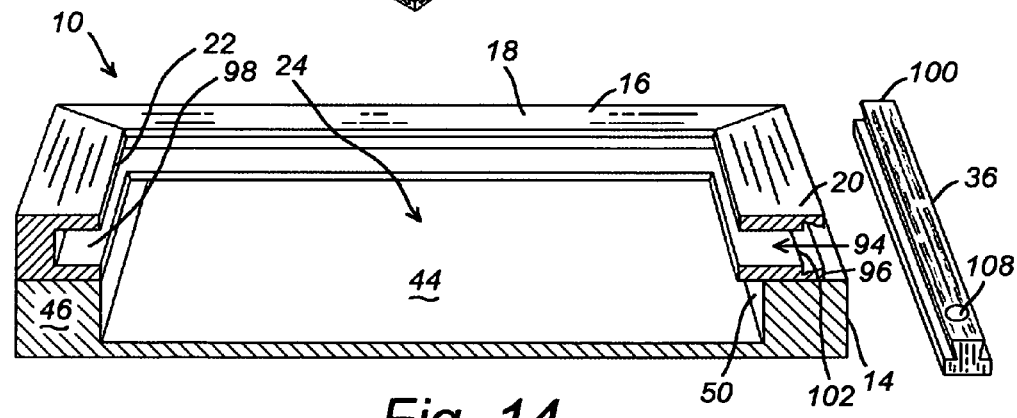
FIG. 14 is a cross-section that illustrates the edge slot opening of the peripheral picture frame being substantially continuous with the inner peripheral picture slot for the picture stack.

FIG. 14 is a cross-section that illustrates inner peripheral picture slot 98 of peripheral picture frame 18. As illustrated, inner peripheral picture slot 98 extends the entire inner periphery of picture frame 18 and is substantially aligned with picture display opening 22. Accordingly, when picture stack 112 is installed into picture slot 98, picture card 12 is substantially centered in display area 24 in front surface 20 of picture frame lid 16 and framed by picture frame 18. As further illustrated here, edge slot opening 94 is substantially continuous with inner peripheral picture slot 98, whereby picture stack 112 is installed into picture slot 98 through slot opening 94.

Figure 15:
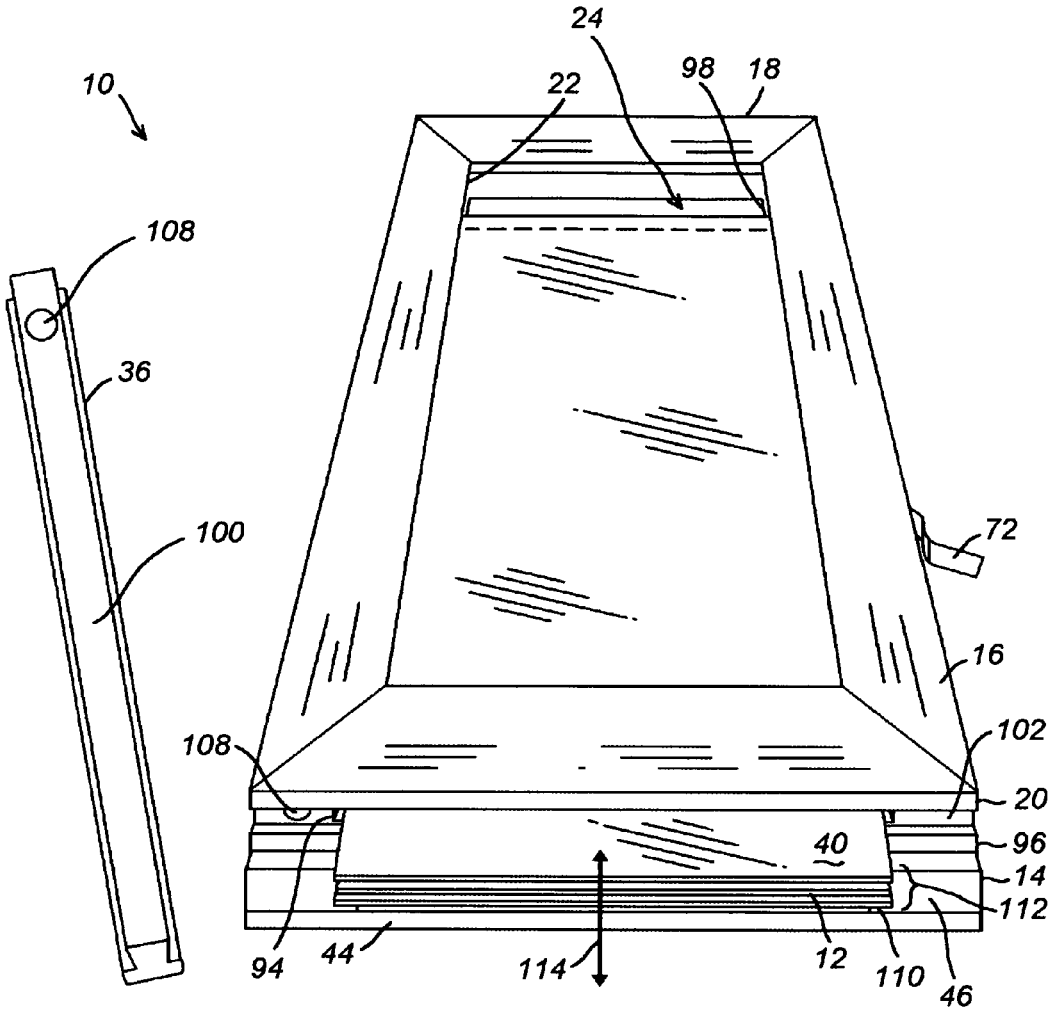
FIG. 15 illustrates closed display box having its door slide removed and the sandwiched picture stack being installed or removed from the inner peripheral picture slot through the edge slot opening.

FIG. 15 illustrates closed display box 10 having door slide 36 removed from peripheral picture frame 18. Here, sandwiched picture stack 112 is being installed or removed from (arrow 114) picture slot 98 through edge slot opening 94. As illustrated, edge slot opening 94 and inner peripheral picture slot 98 are sized to sliding receive sandwiched picture stack 112 when door slide 36 removed from peripheral picture frame 18.

Figure 16:
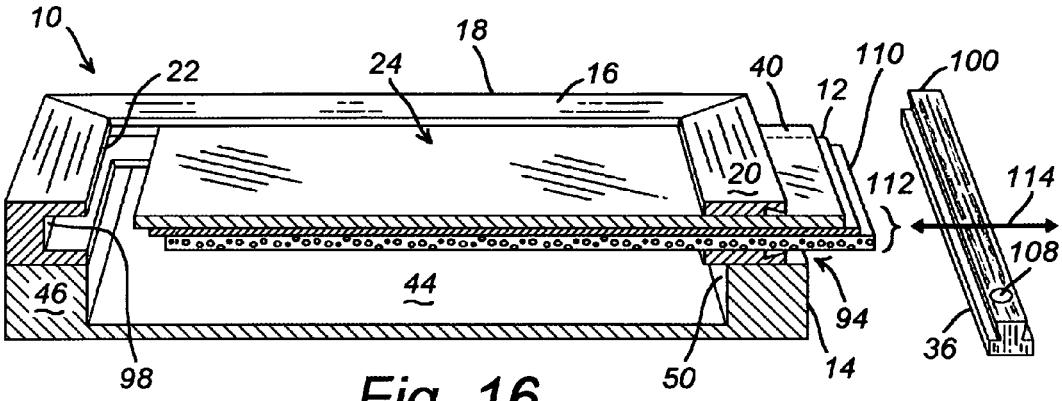
FIG. 16 is a cross-section that illustrates the closed display box with its door slide removed and the sandwiched picture stack being installed or removed from the inner peripheral picture slot through the edge slot opening.

FIG. 16 is a cross-section that illustrates closed display box 10 with door slide 36 removed from peripheral picture frame 18, and sandwiched picture stack 112 being installed or removed from (arrow 114) picture slot 98 through edge slot opening 94.

Figure 17:
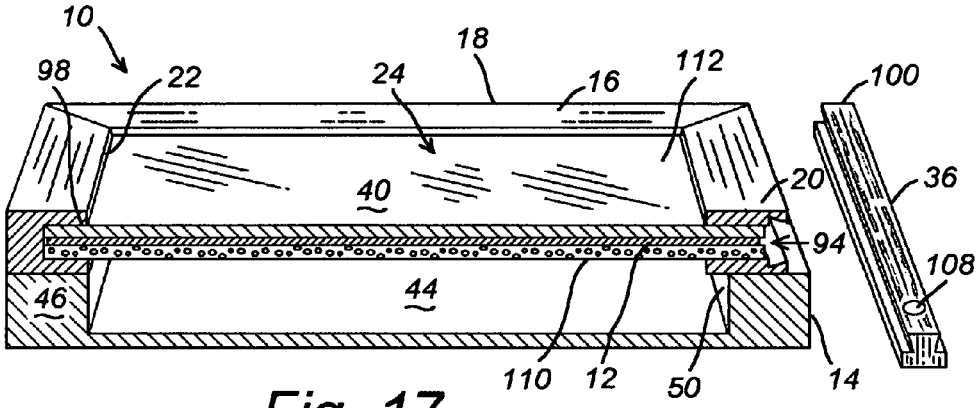
FIG. 17 is a cross-section that illustrates the closed display box with the sandwiched picture stack fully installed into the inner peripheral picture slot before the door slide is replaced.

FIG. 17 is a cross-section that illustrates closed display box 10 with sandwiched picture stack 112 fully installed into picture slot 98 through edge slot opening 94. Hereafter, door slide 36 is installed into peripheral picture frame 18 into a position that covers edge slot opening 94 and secures sandwiched picture stack 112 within inner peripheral picture slot 98 and display area 24 of picture frame lid 16.

Figure 18:
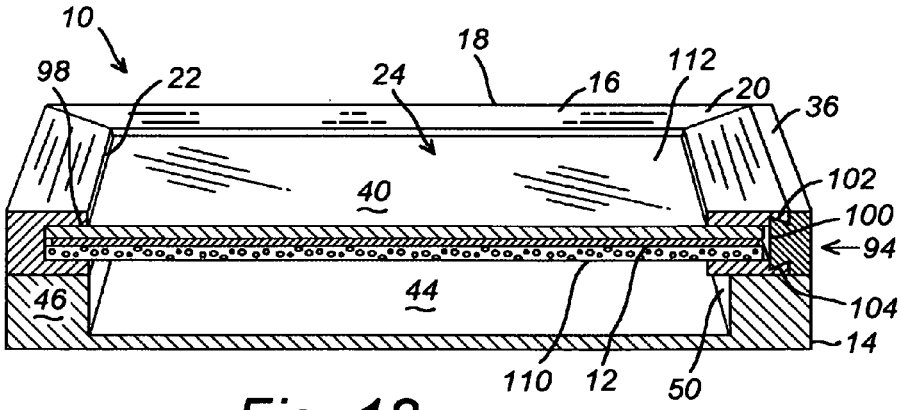
FIG. 18 is a cross-section that illustrates the closed display box with the sandwiched picture stack fully installed therein for viewing in the display area of the picture frame lid.

FIG. 18 is a cross-section that illustrates closed display box 10 with sandwiched picture stack 112 fully installed into picture slot 98 through edge slot opening 94 and door slide 36 installed into peripheral picture frame 18 into a position that covers edge slot opening 94 and secures sandwiched picture stack 112 within inner peripheral picture slot 98 and display area 24 of picture frame lid 16. As illustrated here, flaring tenon projection 100 of door slide 36 is mated with mortise slot 102 of picture frame 18 in sliding dovetail slip joint 104. When fully mated with mortise slot 102, door slide 36 is secured in position over edge slot opening 94 of picture frame 18 by the pair of rare earth magnets 108 of magnetic securing mechanism 106.

While the preferred and additional alternative embodiments of the invention have been illustrated and described, it will be appreciated that various changes can be made therein without departing from the spirit and scope of the invention. Therefore, it will be appreciated that various changes can be made therein without departing from the spirit and scope of the invention. Accordingly, the inventor makes the following claims.

What is claimed is:

1. A decorative display box, comprising:

a generally rectangular storage box base (14) comprising four uptight side panels (52, 54, 56, 58) mutually interconnected at mating comers (60) and forming therebetween a generally rectangular continuous peripheral box frame (46), and further comprising a generally rectangular base panel (44) interconnected with the four side panels (52, 54, 56, 58) along a bottom edge (62) of box frame (46) and cooperating therewith for defining an interior cavity (50) having a generally rectangular opening (48) thereinto;

a generally rectangular picture frame (16) comprising a peripheral picture frame (18) having a front surface (20) and a back surface (96), the front surface (20) framing a picture display opening (22) therein defining a display area (24), and an inner peripheral slot (98) between the front and back frame surfaces (20, 96) surrounding and communicating with the picture display opening (22), the inner peripheral slot (98) being configured for receiving and securing therein a picture (12) and at least partially exposing the picture (12) in the display area (24) defined by the picture display opening (22);

a hinge mechanism (74) pivotally connecting adjacent hinged edges (75, 78) of the peripheral box frame (46) and the peripheral picture frame (18), whereby the picture frame (16) cooperates to form a lid for the storage box (14) with the hinge mechanism (74) operable for pivoting the picture frame (16) between a closed position covering the opening (48) into the interior cavity (50) of the storage box (14) with the peripheral picture frame (18) in substantially continuous contact with the peripheral box frame (46), and an open position uncovering the opening (48) into the interior cavity (50) of the storage box (14) with the peripheral picture frame (18) displaced from contact with the peripheral box frame (46), the picture frame (16) further comprising:

a slot opening (94) through an outer peripheral edge surface (90) of the peripheral picture frame (18) between the front and back frame surfaces (20, 96) and communicating with the inner peripheral slot (98) between the front and back frame surfaces (20, 96), and a door member (36) slidingly interconnected therewith along the outer peripheral edge surface (90) of the peripheral picture frame (18) thereof adjacent to the slot (94) opening therethrough;

a first magnetic securing mechanism (80) positioned between opposing edges (92, 90) of the peripheral box frame (46) and the peripheral picture frame (18) opposite from the hinged edges (76, 78) thereof, the magnetic securing mechanism (80) being operable for securing the picture frame (18) in the closed position covering the opening (48) into the interior cavity (50) of the storage box (14); and a second magnetic securing mechanism (106) operable between the outer peripheral edge surface (90) of the peripheral picture frame (18) and the door member (36), the second magnetic securing mechanism (106) further comprising a pair of magnets (108), with one of the pair of magnets (108) embedded in each of the edge surface (90) of the peripheral picture frame (108) and the door member (36), the pair of magnets (108) being relatively positioned for interacting magnetically when the door member (36) is in a closed position substantially juxtaposed with the slot opening (94) through the outer peripheral edge surface (90) of the peripheral picture frame (18) between the front and back frame surfaces (20, 96).

2. The display box of claim 1, wherein the first magnetic securing mechanism (80) further comprises a pair of rare earth magnets (86), with one of the pair of magnets (86) embedded in each of the peripheral box frame (46) and the peripheral picture frame (18), the pair of magnets (86) being relatively positioned interact magnetically when the picture frame (16) is in the closed position.

3. The display box of claim 1, wherein the outer peripheral edge surface (90) of the peripheral picture frame (18) and the outer peripheral edge surface (92) of the peripheral box frame (46) are substantially flush when the picture frame (16) is in the closed position.

4. The display box of claim 1, wherein the slot opening (94) communicating with the inner peripheral slot (98) between the front and back frame surfaces (20, 96) is further substantially continuous therewith.

5. The display box of claim 4, wherein the slot opening (94) and the inner peripheral slot (98) between the front and back frame surfaces (20, 96) are further adapted for receiving a picture stack (112).

6. The display box of claim 5, wherein the hinge mechanism (74) further comprises a hidden hinge mechanism that is completely enclosed between mating surfaces of the peripheral picture frame (18) and the peripheral box frame (46) when the picture frame (16) is in the closed position with the peripheral picture frame (18) in substantially continuous contact with the peripheral box frame (46), whereby the hinge mechanism (74) is invisible when the picture frame (16) is in the closed position.

7. The display box of claim 6, wherein in the closed position the peripheral picture frame (18) is substantially flush with the peripheral box frame (46), whereby the hinge mechanism (74) is invisible when the picture frame (16) is in the closed position regardless of viewing angle.

8. The display box of claim 1, wherein the picture frame (16) further comprises a dovetail joint (104) between the outer peripheral edge surface (90) of the peripheral picture frame (18) and the door member (36), the door member (36) further comprising a flaring tenon (100), and the edge surface (90) of the peripheral frame further comprising a mating mortise (102).

9. The display box of claim 1, wherein the pair of magnets (108) further comprises a pair of rare earth magnets.

10. The display box of claim 1, further comprising one or more fingerhole indentations (88) between opposing edges (82, 84) of the peripheral box frame (46) and the peripheral picture frame (18) opposite from the hinge mechanism (74).

11. A decorative display box, comprising:

a storage box base (14) comprising a generally rectangular peripheral box frame (46), and further comprising a generally rectangular base panel (44) interconnected with the peripheral box frame (46) along a bottom edge (62) thereof and cooperating therewith for defining an interior cavity (50) having a generally rectangular opening (48) thereinto;

a generally rectangular picture frame (16) cooperating with the storage box (14) for forming a lid therefor, the picture frame (16) comprising a peripheral picture frame (18) having a front surface (20) and a back surface (96), the front surface (20) framing a picture display opening (22) therein defining a display area (24), and an inner peripheral slot (98) between the front and back frame surfaces (20, 96) surrounding and communicating with the picture display opening (22), the inner peripheral slot (98) comprising means for receiving and securing therein a picture (12), and wherein the picture (12) is at least partially exposed in the display area (24) defined by the picture display opening (22), the picture frame (16) further comprising a securable door member (36) slidingly interconnected therewith along the outer peripheral edge surface (90) of the peripheral picture frame (18) thereof adjacent to a slot (94) opening therethrough between the front and back frame surfaces (20, 96);

a hinge means (74) for pivotally connecting the peripheral box frame (46) and the peripheral picture frame (18), the hinge mechanism (74) being operable for pivoting the picture frame (16) between a closed position covering the opening (48) into the interior cavity (50) of the storage box (14), and an open position uncovering the opening (48) into the interior cavity (50) of the storage box (14), a first magnetic securing means (80) for securing the picture frame (18) in the closed position covering the opening (48) into the interior cavity (50) of the storage box (14), the first magnetic securing means (80) being positioned between opposing edges (92, 90) of the peripheral box frame (46) and the peripheral picture frame (18) opposite from the hinge means (74); and a second magnetic securing means (106) operable between the outer peripheral edge surface (90) of the peripheral picture frame (18) and the door member (36), and wherein the second magnetic securing means (106) further comprises a pair of magnets (108), with one of the pair of magnets (108) embedded in each of the edge surface (90) of the peripheral picture frame (18) and the door member (36), the pair of magnets (18) being relatively positioned for magnetically securing the door member (36) is in a closed position substantially covering the slot opening (94) through the outer peripheral edge surface (90) of the peripheral picture frame (18).

12. The display box of claim 11, wherein the first magnetic securing means (80) for securing the picture frame (18) in the closed position further comprises a pair of magnets (86), with one of the pair of magnets (86) embedded in each of the peripheral box frame (46) and the peripheral picture frame (18), the pair of magnets (86) being relatively positioned interact magnetically when the picture frame (16) is in the closed position.

13. The display box of claim 12, wherein dimensions of the outer peripheral edge surface (90) of the peripheral picture frame (18) and dimensions of the outer peripheral edge surface (92) of the peripheral box frame (46) are substantially identical.

14. The display box of claim 11, wherein the inner peripheral slot (98) between the front and back frame surfaces (20, 96) is further adapted for receiving thereinto a picture stack (112), the picture stack (112) comprising the picture (12), a transparent protective viewing lens (40) and a support substrate (110); and wherein the slot opening (94) through the outer peripheral edge surface (90) of the peripheral picture frame (18) between the front and back frame surfaces (20, 96), further communicates with the inner peripheral slot (98) between the front and back frame surfaces (20, 96) and is further adapted for receiving the picture stack (112) therethrough and into the inner peripheral slot (98).

15. The display box of claim 14, wherein the hinge means (74) further comprises a pair of hidden hinges positioned between mating surfaces of the peripheral picture frame (18) and the peripheral box frame (46), whereby the hinge means (74) is completely invisible when the picture frame (16) is in the closed position.

16. The display box of claim 15, wherein in the closed position the peripheral picture frame (18) is substantially flush with the peripheral box frame (46), whereby the hinge mechanism (74) is invisible when the picture frame (16) is in the closed position regardless of viewing angle.

17. A method for displaying a picture and storing additional pictures, the method comprising:

(a) providing a storage box base (14) comprising interconnecting a generally rectangular base panel (44) along a bottom edge (62) of a generally rectangular peripheral box frame (46) and cooperating therewith for defining an interior cavity (50) having a generally rectangular opening (48) thereinto;

(b) for cooperating with the storage box (14), providing a generally rectangular picture frame lid (16) comprising a peripheral picture frame (18) formed between a front surface (20) and a back surface (96), framing a picture display opening (22) in the front surface (20) with the picture display opening (22) defining a display area (24), and providing an inner peripheral slot (98) between the front and back frame surfaces (20, 96) surrounding and communicating with the picture display opening (22);

(c) combining a picture (12), a transparent protective viewing lens (40) and a support substrate (110) into a picture stack (112);

(d) adapting the inner peripheral slot (98) for receiving and securing therein the picture stack (112) having the picture (12) at least partially exposed in the display area (24) defined by the picture display opening (22), wherein adapting the inner peripheral slot (98) for receiving and securing therein the picture stack (112) further comprises forming a slot opening (94) through the outer peripheral edge surface (90) of the peripheral picture frame (18) between the front and back frame surfaces (20, 96) communicating with the inner peripheral slot (98) between the front and back frame surfaces (20, 96) and adapting the slot opening (94) for receiving the picture stack (112) therethrough and into the inner peripheral slot (98);

(e) interconnecting a hinge mechanism (74) between the storage box (14) and the picture frame (16) for pivotally connecting the peripheral box frame (46) and the peripheral picture frame (18) in a manner such that the hinge mechanism (74) is operable for pivoting the picture frame (16) between a closed position covering the opening (48) into the interior cavity (50) of the storage box (14) and an open position uncovering the opening (48) into the interior cavity (50) of the storage box (14);

(f) operating a lid securing mechanism (80) between opposing edges (92, 90) of the peripheral box frame (46) and the peripheral picture frame (18) opposite from the hinge mechanism (74) for generating a securing force (95) adapted for securing the picture frame (16) in the closed position relative to the storage box (14);

(g) applying an opening force (93) between the opposing edges (92, 90) of the peripheral box frame (46) and the peripheral picture frame (18) opposite from the hinge (74) for overcoming the securing force (95) of the lid securing mechanism (80);

(h) operating the hinge mechanism (74) for pivoting the picture frame (16) from the closed position covering the opening (48) into the interior cavity (50) of the storage box (14) and into the open position uncovering the opening (48) into the interior cavity (50) of the storage box (14); and (i) operating the hinge mechanism (74) for pivoting the picture frame (16) from the open position uncovering the opening (48) into the interior cavity (50) of the storage box (14) and into the closed position covering the opening (48) into the interior cavity (50) of the storage box (14);

(j) operating the lid securing mechanism (80) for securing the picture frame (18) in the closed position covering the opening (48) into the interior cavity (50) of the storage box (14);

(k) with the picture stack (112) received into the inner peripheral slot (98) of the picture frame lid (16), slidingly interconnecting a securable door member (36) with the picture frame lid (16) along the outer peripheral edge surface (90) of the peripheral picture frame (18) thereof adjacent to the slot opening (94) therethrough; and (l) operating a magnetic door member securing mechanism (106) between the outer peripheral edge surface (90) of the peripheral picture frame (18) and the door member (36) for magnetically securing the door member (36) in a closed position at least partially covering the slot opening (94) through the outer peripheral edge surface (90) of the peripheral picture frame (18) and securing the picture stack (112) within the inner peripheral slot (98) with the picture (12) at least partially exposed in the display area (24) defined by the picture display opening (22), the magnetic securing mechanism (106) comprising a pair of magnets (108) with one of the pair of magnets (108) embedded in each of the edge surface (90) of the peripheral picture frame (18) and the door member (36) and the pair of magnets (108) being relatively positioned for interacting magnetically when the door member (36) is in a closed position substantially juxtaposed with the slot opening (94) through the outer peripheral edge surface (90) of the peripheral picture frame (18) between the front and back frame surfaces (20, 96).

18. The method of claim 17, further comprising embedding the lid securing mechanism (80) in opposing edges (92, 90) of the peripheral box frame (46) and the peripheral picture frame (18) opposite from the hinge mechanism (74).

19. The method of claim 17, wherein securing the door member (36) in a closed position at least partially covering the slot opening (94) through the outer peripheral edge surface (90) of the peripheral picture frame (18) further comprises substantially completely covering the slot opening (94).

20. The method of claim 17, wherein interconnecting a hinge mechanism (74) between the storage box (14) and the picture frame (16) further comprises interconnecting a hidden hinge mechanism (74) between the storage box (14) and the picture frame (16);and wherein, in the closed position of the picture frame (16) covering the opening (48) into the interior cavity (50) of the storage box (14), the peripheral picture frame (18) is positioned substantially flush with the peripheral box frame (46), whereby the hidden hinge mechanism (74) is invisible when the picture frame (16) is in the closed position regardless of viewing angle.

* * * * *